US005089350A

United States Patent [19]

Talvalkar et al.

[11] Patent Number: 5,089,350

[45] Date of Patent: Feb. 18, 1992

[54] THERMAL TRANSFER RIBBON

[75] Inventors: Shashi G. Talvalkar, Kettering; Thomas J. Obringer, Vandalia; Richard D. Puckett, Miamisburg, all of Ohio

[73] Assignee: NCR Corporation, Dayton, Ohio

[21] Appl. No.: 431,692

[22] Filed: Nov. 3, 1989

Related U.S. Application Data

[63] Continuation of Ser. No. 187,138, Apr. 28, 1988, abandoned.

[51] Int. Cl.[5] ..... B41M 5/26

[52] U.S. Cl. ..... 428/484; 428/195; 428/488.1; 428/522; 428/690; 428/913; 428/914

[58] Field of Search ..... 428/216, 207, 336, 484, 428/488.1, 690, 913, 914, 195, 522

[56] References Cited

U.S. PATENT DOCUMENTS

| | | | |
|---|---|---|---|
| Re. 30,274 | 5/1980 | Bolon et al. | 252/512 |
| 3,117,018 | 1/1964 | Strauss | 117/36 |
| 3,412,043 | 11/1968 | Gilliland | 252/514 |
| 3,663,278 | 5/1972 | Blose et al. | 117/234 |
| 3,746,662 | 7/1973 | Adelman | 252/514 |
| 3,968,056 | 7/1976 | Bolon et al. | 361/411 |
| 4,053,660 | 10/1977 | Hurwitz et al. | 428/914 |
| 4,251,276 | 2/1981 | Ferree et al. | 106/27 |
| 4,272,292 | 6/1981 | Mizuno et al. | 106/22 |
| 4,307,149 | 12/1981 | Scott et al. | 428/913 |
| 4,406,826 | 9/1983 | Morgan et al. | 427/102 |
| 4,461,586 | 7/1984 | Kawanishi et al. | 400/120 |
| 4,474,844 | 10/1984 | Omori et al. | 428/216 |
| 4,479,997 | 10/1984 | Masterson et al. | 428/484 |
| 4,604,298 | 8/1986 | Shevtchuk et al. | 427/96 |
| 4,614,682 | 9/1986 | Suzuki et al. | 428/213 |
| 4,624,891 | 11/1986 | Sato et al. | 428/321 |
| 4,627,997 | 12/1986 | Ide | 428/216 |

FOREIGN PATENT DOCUMENTS

| | | | |
|---|---|---|---|
| 55-187653 | 12/1980 | Japan . | |
| 71388 | 3/1988 | Japan | 428/913 |
| 2163270 | 2/1986 | United Kingdom | 428/913 |

OTHER PUBLICATIONS

Patent Abstracts of Japan, vol. 8, No. 158 (M-311) (1595) Jul. 21, 1984 and JP, A, 5954598 (Fuji Kagaku Shikougiyou K.K.) Mar. 29, 1984.

One of the inventors circulated experimental test patterns prepared in accordance with Example 4 of this application at a National Electronics Convention (NEPCON), held at Anaheim, Calif., Feb. 23-25, 1988.

Chem. Week, Apr. 27, 1988, p. 18, "New Versatile Inks etc.".

*Primary Examiner*—Pamela R. Schwartz

*Attorney, Agent, or Firm*—George J. Muckenthaler

[57] ABSTRACT

A thermal transfer ribbon includes a substrate and a layer thereon comprising a mixture of an emulsion essentially consisting of hydrocarbon, paraffin and carnauba waxes and an acetate copolymer, and a fluorescent color coating essentially containing a fluorescent pigment, a color toner and a filler.

15 Claims, 2 Drawing Sheets

THERMAL TRANSFER RIBBON

This is a continuation of co-pending application Ser. No. 187,138 filed on Apr. 28, 1988 is now abandoned.

BACKGROUND OF THE INVENTION

In the printing field, the impact type printer has been the predominant apparatus for providing increased throughput of printed information. The impact printers have included the dot matrix type wherein individual print wires are driven from a home position to a printing position by individual and separate drivers. The impact printers also have included the full character type wherein individual type elements are caused to be driven against a ribbon and paper or like record media adjacent and in contact with a platen.

The typical and well-known arrangement in a printing operation provides for transfer of a portion of the ink from the ribbon to result in a mark or image on the paper. Another arrangement includes the use of carbonless paper wherein the impact from a print wire or a type element causes rupture of encapsulated material for marking the paper. Also known are printing inks which contain magnetic particles wherein certain of the particles are transferred to the record media for encoding characters in manner and fashion so as to be machine readable in a subsequent operation. One of the known encoding systems is MICR (Magnetic Ink Character Recognition) utilizing the manner of operation as just mentioned.

While the impact printing method has dominated the industry, one disadvantage of this type printing is the noise level which is attained during printing operation. Many efforts have been made to reduce the high noise levels by use of sound absorbing or cushioning materials or by isolating the printing apparatus.

More recently, the advent of thermal printing which effectively and significantly reduces the noise levels has brought about the requirements for heating of extremely precise areas of the record media by use of relatively high currents. The intense heating of the localized areas causes transfer of ink from a ribbon onto the paper. Alternatively, the paper may be of the thermal type which includes materials that are responsive to the generated heat.

The use of thermal printing with different color inks has also been proposed and applied in certain technologies. An application for thermal printing has included the postal system which makes use of one or more fluorescent pigments.

Representative documentation in the area of nonimpact printing includes U.S. Pat. No. 3,117,018, issued to E. Strauss on Jan. 7, 1964, which discloses a color transfer medium and method of producing the same by applying a coating consisting of a polycarbonate, a solvent, a plasticizer and a pigment, and then drying the coating to form a solid transfer layer.

U.S. Pat. No. 4,663,278, issued to J. H. Blose et al. on May 16, 1972, discloses a thermal transfer medium having a base with a transferable coating composition of a cellulosic polymer, a thermoplastic resin, a plasticizer, and a sensible dye or oxide pigment material.

U.S. Pat. No. 4,251,276, issued to W. I. Ferree et al. on Feb. 17, 1981, discloses a transfer ribbon having a substrate coated with a thermally-active ink composition comprising a thermally-stable polymer, an oil-gelling agent, and an oil-dissolving medium or plasticizer present in a percentage by weight of the total nonvolatile components.

U.S. Pat. No. 4,272,292, issued to S. Mizuno et al. on June 9, 1981, discloses an ink composition comprising at least one of the carbinol bases of the basic dyes, a strong base, a binder and a solvent.

U.S. Pat. No. 4,461,586, issued to T. Kawanishi et al. on July 24, 1984, discloses an ink ribbon having an electroconductive base layer comprising a binder resin and an electroconductive material, and an electroconductive ink layer comprising a thermoplastic material and an electroconductive material.

U.S. Pat. No. 4,474,844, issued to T. Omori et al. on October 1984, discloses a heat transfer recording medium comprising tissue paper with a thermal-responsive ink layer. The paper thickness, density and smoothness are set out by measurement and water content is a percentage of the ink layer.

U.S. Pat. No. 4,614,682, issued to A. Suzuki et al. on Sept. 30, 1986, discloses a thermo-sensitive image transfer recording medium comprising a support and an ink layer consisting of a dye, a binder and a pigment of needle-like crystal form.

U.S. Pat. No. 4,624,891, issued to H. Sato et al. on Nov. 25, 1986, discloses heat transfer material comprising a micro-network porous resin of thermoplastic resin and heat fusible gel ink which comprises a colorant, an oil and a gelatin agent.

And, U.S. Pat. No. 4,627,997, issued to Y. Ide on Dec. 9, 1986, discloses a thermal transfer recording medium comprising an inking layer of a fluorescent substance, a coloring agent, waxes, and a binder on a substrate.

SUMMARY OF THE INVENTION

The present invention relates to nonimpact printing. More particularly, the invention provides a coating formulation or composition and a thermal ribbon or transfer medium for use in imaging or encoding characters on paper or like record media documents which enable machine, human, or reflectance reading of the imaged or encoded characters. The thermal transfer ribbon enables printing in quiet and efficient manner and makes use of the advantages of thermal printing on documents with a signal inducible ink.

The ribbon comprises a thin, smooth substrate such as tissue-type paper or polyester-type plastic on which is applied a thermal-responsive layer or coating that generally includes a wax mixture dispersed in a binding mix of an ethylene copolymer and/or a hydrocarbon resin to form the wax emulsion. The hydrocarbon resin and the solids of the wax emulsion are mixed or dispersed into solution with dyes and fluorescent pigments in an attritor or other conventional dispersing equipment. The thermal-responsive layer or coating ingredients include a red-orange base, a red toning pigment, a filler, and a yellow fluorescent pigment. The coating is then applied to the substrate by well-known or conventional coating techniques.

In view of the above discussion, a principal object of the present invention is to provide a ribbon including a thermal-responsive coating thereon.

Another object of the present invention is to provide a thermal transfer ribbon substrate including a coating thereon for use in imaging or encoding operations.

An additional object of the present invention is to provide a coating on a ribbon substrate having ingredients in the coating which are responsive to heat for transferring a portion of the coating to paper or like record media.

A further object of the present invention is to provide a coating on a ribbon substrate, which coating includes a pigment material and a wax emulsion dispersed in a binder mix and which is responsive to heat for transferring the coating in precise printing manner to paper or like record media.

Still another object of the present invention is to provide a thermally-activated coating on a ribbon that is completely transferred from the base of the ribbon onto the paper or document in an imaging operation in printing manner at precise positions and during the time when the thermal elements are activated to produce a well-defined and precise or sharp image.

Still an additional object of the present invention is to provide a coating consisting essentially of a wax emulsion and fluorescent pigments and which coating is applied to a substrate.

Still a further object of the present invention is to provide a two stage process which includes the preparation of a specific wax emulsion and the preparation of a transfer coating for use in thermal printing.

Still another object of the present invention is to provide a heat sensitive, fluorescent type, transfer ribbon created by use of fluorescent pigments, waxes, resins, dyes and plasticizers to transfer a sharp image from a tissue or a polyester base substrate in a temperature range of 50° C. to 125° C.

Additional advantages and features of the present invention will become apparent and fully understood from a reading of the following description taken together with the annexed drawing.

DESCRIPTION OF THE PREFERRED EMBODIMENT

The thermal transfer coating of the present invention is specifically designed and formulated to provide a transfer mark or image which meets specific criteria or requirements for a fluorescent red thermal transfer ribbon which is suitable and acceptable for postal applications.

Fluorescence of the ribbon should be greater than 10 pmu (postage meter unit). The peak wavelength of the fluorescence is at 625±25 nm (nanometers).

The color of the transferred image is controlled to be within the coloring of a reddish-orange hue similar to the color of the postage meter indicia.

And, the color of the transferred image, as determinated on a 7/8 inch square, will have values of L=45, a=62 and b=20 on the Hunter Color Meter. L is defined as a measure of lightness, a is a measure on the red-green axis, and b is a measure on the blue-yellow axis. A variance of ±5 is allowed for the value of L with total color difference (Δ) not to exceed 10 when using the formula:

$$\Delta=\sqrt{(\Delta L)^2+(\Delta a)^2+(\Delta b)^2}$$

Figure 1:
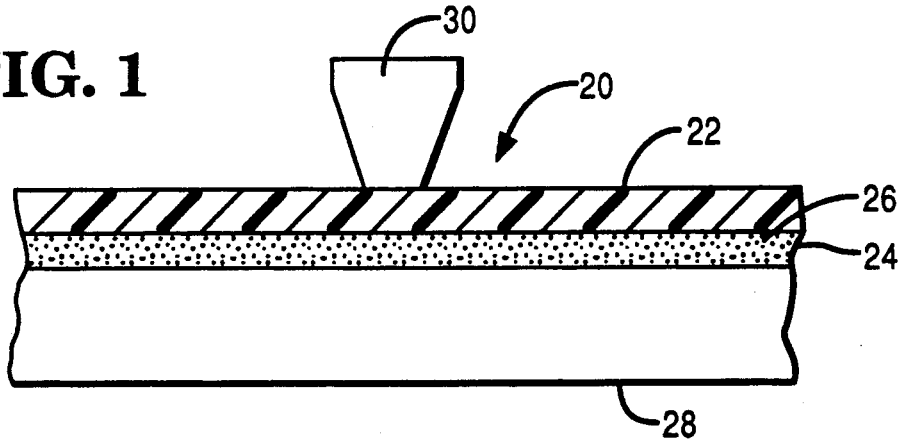
FIG. 1 illustrates a thermal element operating with a ribbon base having a transfer coating thereon incorporating the ingredients as disclosed in the present invention.
Figure 2:
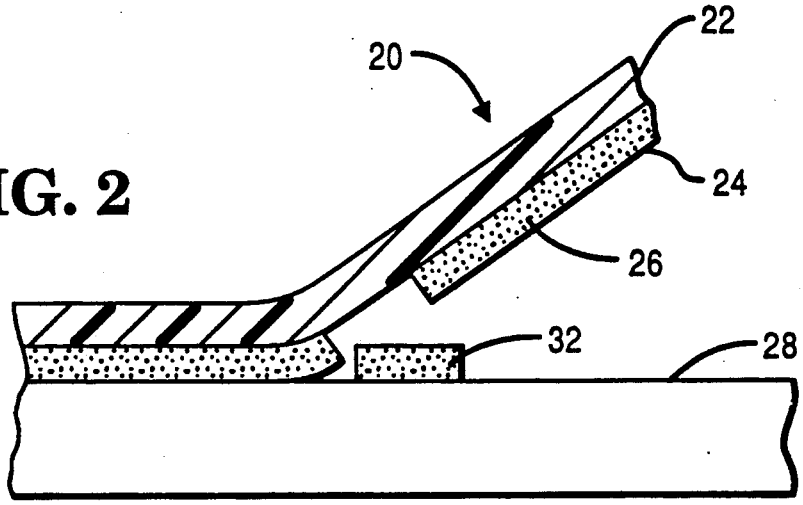
FIG. 2 shows the receiving paper with a part of the coating transferred in the form of a character onto the receiving paper.

The transfer ribbon 20, as illustrated in FIGS. 1 and 2, comprises a base or substrate 22 of thin, smooth, tissue-type paper or polyester-type plastic or like material having a coating 24 which is thermally activated and includes nonmagnetic pigment or particles 26 as an ingredient therein for use in imaging or encoding operations to enable human or reflectance reading of characters. Each character that is imaged on a receiving paper 28 or like record media produces a unique waveform that is recognized and read by the reader. In the case of thermal transfer ribbons relying solely on the nonmagnetic thermal printing concept, the pigment or particles 26 include coloring materials such as pigments, fillers and dyes.

As alluded to above, it is noted that the use of a thermal printer having a print head element, as 30, substantially reduces noise levels in the printing operation and provides reliability in imaging or encoding of paper or like documents 28. The thermal transfer ribbon 20 provides the advantages of thermal printing while encoding or imaging the document 28 with a nonmagnetic signal inducible ink. When the heating elements 30 of a thermal print head are activated, the imaging or encoding operation requires that the pigment or particles of material 26 on the coated ribbon 20 be completely transferred from the ribbon to the document 28 in manner and form to produce the precisely defined characters 32 for recognition by the reader. In the case of nonmagnetic thermal printing, the imaging or encoding material 26 is completely transferred to the document 28 to produce the precisely defined characters 32 for recognition and machine, human, or reflectance reading thereof.

Figure 3:
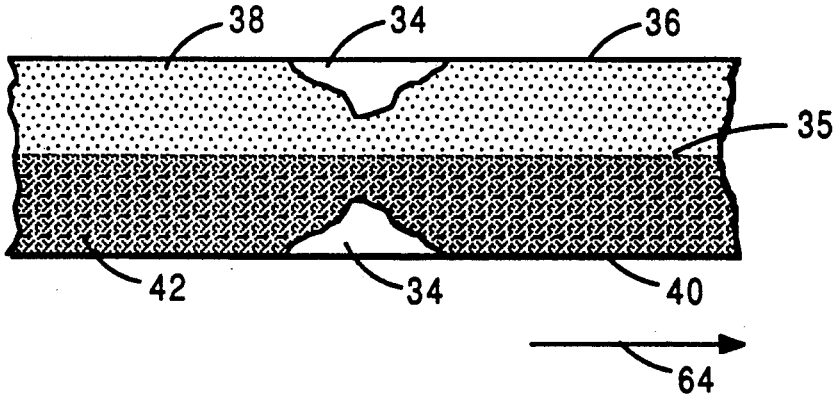
FIG. 3 is a diagrammatic view of a ribbon base having adjacent coatings along the length thereof.

FIG. 3 is a diagrammatic view of a substrate 34 having a width occupied by a fluorescent thermal transfer coating 36 on approximately one half of the substrate and a thermal transfer coating 40 of another color on the other half of the substrate. The coating 36 includes pigment or particles 38 and the coating 40 includes pigment or particles 42. The width of the substrate 34 or of the printed area of the transfer coatings 36 and 40 is dependent upon the configuration of the thermal printer or like apparatus that is used for causing transfer of the image from the base or substrate to the paper or other document. FIG. 3 shows a distinct line of demarcation 35 between the fluorescent coating 36 and the coating 40 of another color. It is understood, of course, that minor variations of either an uncoated or clear strip along the line 35 or an overlapping of the coatings 36 and 40 may unintentionally occur.

Figure 4:
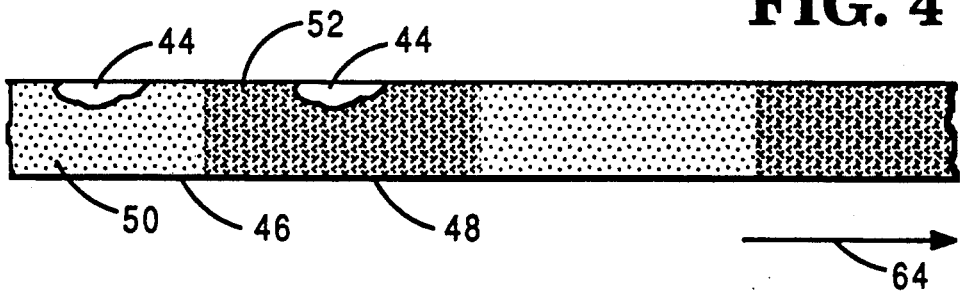
FIG. 4 is a diagrammatic view of a ribbon base having repeated coatings in a modified arrangement.

FIG. 4 is a diagrammatic view of a substrate 44 having a portion thereof coated with a fluorescent thermal transfer coating 46 and an adjacent portion coated with a thermal transfer coating 48 of another color. The coatings 46 and 48 are repeated along the length of the substrate 44. The coating 46 has pigment or particles 50 and the coating 48 has pigment or particles 52.

Figure 5:
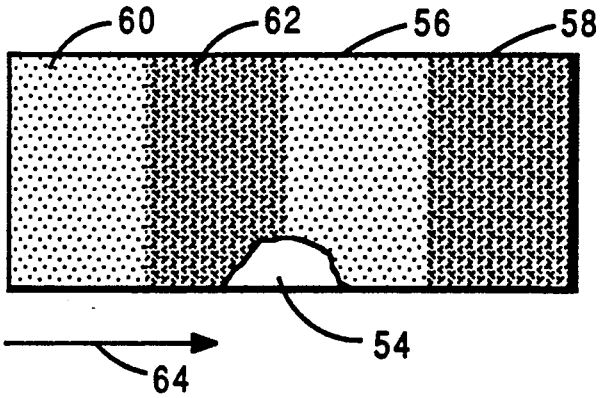
FIG. 5 is another modified arrangement of repeated coatings.

FIG. 5 is a diagrammatic view of a wider substrate 54 having a narrow portion thereof coated with a fluorescent thermal transfer coating 56 and an adjacent narrow portion coated with a thermal transfer coating 58 of another color. The coatings 56 and 58 are repeated along the length of the substrate. The coating 56 contains pigment or particles 60 and the coating 58 contains pigment or particles 62. The arrows 64 indicate the direction in which the transfer ribbon is advanced or transported in a printing or imaging operation.

The thermal transfer ribbon of the present invention is produced in a two stage process wherein the first stage includes preparation of a specific wax emulsion or formulation, and the second stage includes preparation of the transfer coating or layer.

Generally, a wax adhesive emulsion uses hydrocarbon, paraffin or ozocerite, carnauba, microcrystalline waxes and an ethylene vinyl acetate copolymer and/or a hydrocarbon resin soluble in aliphatic solvents. The wax emulsion uses waxes plus the acetate copolymer plus the hydrocarbon resin in one formulation. In another formulation, the wax emulsion uses waxes plus the acetate copolymer or the hydrocarbon resin.

A preferred wax adhesive emulsion or formulation at 20% to 50% solids to satisfy the requirements of the first stage of the process includes the specific ingredients in appropriate amounts as set forth in Table 1 of Example I.

EXAMPLE I

TABLE 1

| Wax Emulsion | Percent Dry | Wet Amt. | % Dry Range |
|---|---|---|---|
| WB-7 Wax | 27 | 169.6 | 20–45% |
| Paraffin 162 Wax | 46 | 289.3 | 35–65% |
| Carnauba #3 Wax | 20 | 125.8 | 5–30% |
| Elvax 4310 | 7 | 44.3 | 3–15% |
| Mineral Spirits | | 1361.3 | |
| | 100 | 1990.3 | |
| | | (31.6% Solids) | |

The nonvolatile materials in the above formulation equate from 20% to 50%, and it is here noted that Lacolene, or VM and P Naptha, can be substituted in place of the mineral spirits. The wax emulsion is heated to 60° C. while mixing the above solution and then is allowed to cool to room temperature at the end of the first stage.

The second stage of the process includes preparation of a preferred fluorescent color, thermal transfer coating wherein the above wax emulsion is heated to a range within 40°–45° C. and the following ingredients in appropriate amounts, as set forth in Table 2, are placed into dispersion equipment such as a ball mill, a shot mill, a sand mill, or an attritor, and then ground for a period of approximately 20–40 minutes, or for a sufficient period of time to provide a uniform fine (3–5 microns size) dispersion.

TABLE 2

| Coating | Percent Dry | Wet Amt. | % Dry Range |
|---|---|---|---|
| Wax Emulsion (From Table 1) | 79.9 | 1990.3 | 50–90% |
| Red-Orange PM Base (47% Solids) | 6.3 | 49.9 | 5–20% |
| Lithol Scarlet K-3700 | 12.5 | 98.1 | 5–20% |
| Paliogen 3911HD | 1.3 | 10.0 | 0–10% |
| | 100.0 | 2148.3 | |
| Percent Solids 25–50% | | | |

Example II provides the specific ingredients in appropriate amounts for another fluorescent coating which uses different pigments.

EXAMPLE II

TABLE 1

| Wax Emulsion | Percent Dry | Wet Amt. | % Dry Range |
|---|---|---|---|
| Paraffin 162 Wax | 50 | 277.4 | 35–65% |
| WB-17 Wax | 30 | 166.4 | 20–45% |
| Carnauba #3 Wax | 13 | 72.1 | 5–20% |
| Elvax 40W | 7 | 38.8 | 3–15% |
| Mineral Spirits | — | 1313.2 | |
| | 100.0 | 1867.9 | |
| | | (29.7% Solids) | |

TABLE 2

| Coating | Percent Dry | Wet Amt. | % Dry Range |
|---|---|---|---|
| Wax Emulsion (From Table 1) | 72.7 | 1867.9 | 50–90% |
| Red-Orange PM Base (47% Solids) | 9.8 | 159.0 | 5–20% |
| Red Toner #8197 | 7.0 | 53.4 | 5–10% |
| Calcium Carbonate | 8.4 | 64.1 | 3–10% |
| ARC Yellow A16N | 2.1 | 16.0 | 1–4% |
| | 100.0 | 2160.5 | |
| | | (35.3% Solids) | |

Example III provides the specific ingredients in appropriate amounts for yet another fluorescent coating which uses different pigments.

EXAMPLE III

TABLE 1

| Wax Emulsion | Percent Dry | Wet Amt. | % Dry Range |
|---|---|---|---|
| WB-7 Wax | 30 | 187.6 | 20–45% |
| Paraffin 162 Wax | 50 | 311.8 | 35–65% |
| Carnauba #3 Wax | 13 | 80.9 | 5–30% |
| Elvax 4310 | 7 | 44.0 | 3–15% |
| Mineral Spirits | — | 1838.5 | |
| | 100 | 2462.8 | |
| | | (25.3% Solids) | |

TABLE 2

| Coating | Percent Dry | Wet Amt. | % Dry Range |
|---|---|---|---|
| Wax Emulsion (From Table 1) | 64.9 | 2462.8 | 50–90% |
| 10-5C-35-A102 | 23.1 | 247.5 | 15–30% |
| White Pigment | 4.6 | 49.5 | 0–10% |
| Fire Orange | 9.2 | 99.0 | 5–15% |
| | 100.0 | 2858.8 | |
| | | (35.7% Solids) | |

Example IV provides the specific ingredients in appropriate amounts for still another fluorescent coating which uses a hydrocarbon resin and a different arrangement of pigments.

TABLE 1

| Wax Emulsion | Percent Dry | Wet Amt. | % Dry Range |
|---|---|---|---|
| WB-7 Wax | 30 | 158.1 | 20–45% |
| Paraffin 162 Wax | 40 | 210.5 | 35–65% |
| Carnauba #3 Wax | 13 | 68.2 | 5–20% |
| Elvax 40W | 7 | 37.1 | 3–15% |
| Piccotex-75 | 10 | 52.9 | 0–25% |
| Mineral Spirits | — | 1397.0 | — |
| | 100 | 1923.8 | |

TABLE 2

| Coating | Percent Dry | Wet Amt. | % Dry Range |
|---|---|---|---|
| Wax Emulsion (From Table 1) | 69.9 | 1923.8 | 50–90% |
| Red-Orange PM Base | 6.3 | 47.3 | 3–10% |
| Paliogen 3911 HD | 1.3 | 9.7 | 0–10% |
| Lithol Scarlet L-3700 | 12.5 | 94.1 | 5–20% |
| Fire Orange | 10.0 | 75.1 | 5–20% |
| | 100 | 2150.0 | |
| Percent Solids 20–50% | | | |

Paraffin 162 wax is a mixture of solid crystalline hydrocarbons chiefly of the methane series derived from the paraffin distillate portion of crude petroleum and is soluble in benzene, ligroine, warm alcohol, chloroform, turpentine, carbon disulfide and olive oil. WB-7 and WB-17 are oxidized, isocyanated hydrocarbon waxes. Carnauba #3 is a hard, amorphous wax derived by exudation from leaves of the wax palm and is soluble in ether, boiling alcohol and alkalies. Ozocerite is a natural paraffin wax occurring in irregular veins, consists principally of hydrocarbons, is soluble in water and has a variable melting point. Elvax 40W and 4310 are ethylene vinyl acetate copolymers. Piccotex-75 is one of the series of hydrocarbon resins and defined as a hard, color stable, substituted styrene copolymer resin.

The class or group of microcrystalline waxes may also be used in the wax emulsion and essentially consist of petroleum waxes having a higher molecular weight, a higher melting point, and a higher viscosity than paraffin wax.

In the fluorescent color coating portion of the invention, the Lithol Scarlet K-3700 and L-3700, the Paliogen 3911 HD and 10-5C-35-A102 ingredients are toning pigments, and the White Pigment and the Fire Orange are fluorescent pigments. The Red-Orange PM Base is a fluorescent pigment, Red Toner #8197 is a toning pigment, and ARC Yellow A16N is a fluorescent pigment. It is noted that a pigment is defined as a solid that reflects light of certain wavelengths while absorbing light of other wavelengths, without producing appreciable luminescence; in effect, pigments are used to impart color to other materials.

The nonvolatile materials of the fluorescent dispersion are controlled at 25% to 55% for proper viscosity. It should be noted that all ingredients are carefully weighed and solubilized in the mineral spirits using appropriate heat and agitation. After the solution is complete, it is slowly cooled to form a viscous wax dispersion to prepare a thermally active, transfer coating.

The substrate or base 22, which may be 30–40 gauge capacitor tissue, manufactured by Glatz, or 14–35 gauge polyester film as manufactured by duPont under the trademark Mylar, should have a high tensile strength to provide for ease in handling and coating of the substrate. Additionally, the substrate should have properties of minimum thickness and low heat resistance to prolong the life of the heating elements 30 of the thermal print head by reason of reduced print head actuating voltage and the resultant reduction in burn time.

The coating 24 is applied to the substrate 22 by means of conventional coating techniques such as a Meyer rod or like wire-wound doctor bar set up on a typical solvent coating machine to provide a coating thickness in a range of 0.0001 to 0.0004 inches. This coating thickness equates to a coating weight of between 9 and 16 milligrams per four square inches. The coating is made up of approximately 25% to 55% nonvolatile material and is maintained at a desired temperature and viscosity throughout the coating process. A temperature of approximately 40°–45° C. is maintained during the entire coating process. After the coating is applied to the substrate, the web of ribbon is passed through a dryer at an elevated temperature in the range between 93° and 120° C. for approximately 5–10 seconds to ensure good drying and adherence of the coating 24 onto the substrate 22 in making the transfer ribbon 20. The above-mentioned coating weight, as applied by the Meyer rod onto a preferred 9–12 microns thick substrate, overall translates to a total thickness of 12–15 microns. The coating 24 can be fully transferred onto the receiving substrate or paper 28 in the range of 50°–120° C. by changing the ranges of the waxes used in the first step of the process.

The availability of the various ingredients used in the present invention is provided by the following list of companies.

| Material | Supplier |
|---|---|
| WB-7 and WB-17 | Bareco |
| Paraffin 162 Wax | Boler |
| Carnauba #3 Wax | Baldini & Co., Inc. |
| Elvax 40W and 4310 Wax | E. I. duPont |
| Piccotex-75 | Hercules |
| Mineral Spirits | Ashland Chemical Co. |
| Red Orange PM Base | Day-Glo |
| Red Toner #8197 | Paul Uhlich |
| Calcium Carbonate | Omya |
| ARC Yellow A16N | Day-Glo |
| Lithol Scarlet K-3700 | BASF |
| Paliogen 3911 HD | BASF |
| 10-5C-35-A102 | Hilton-Davis |
| White Pigment | Day-Glo |
| Fire Orange | Day-Glo |

The method of thermal transfer of the images by use of a dry ribbon enables the creation of the fluorescent mark or image which is recognized for postage recognition applications. The fluorescent mark or image is produced by suitable software control of a thermal transfer printer to create a bar code or other postal indicia which can be recognized by reading of the mark.

In the case where a dual color ribbon is desired, the arrangement of FIG. 3 can be used wherein a portion of the ribbon width comprises the fluorescent color and the other portion of the ribbon comprises a red, black, blue, yellow color or a mixture of colors. FIGS. 4 and 5 illustrate a sequential arrangement of the fluorescent color and any other color or mixture of colors in repeated manner.

It is thus seen that herein shown and described is a thermal transfer ribbon for use in thermal printing operations which includes a thermal-responsive coating on one surface of the ribbon. The coated ribbon enables transfer of coating material onto documents or like record media during the printing operation to form characters on the media in an imaging or in an encoding nature, permitting machine, or human, or reflectance reading of the characters. Using the above formulations, a ribbon can be produced to meet specific thermal transfer printing mechanism that provides a sharp and scratch-resistant mark. The present invention enables the accomplishment of the objects and advantages mentioned above, and while a preferred embodiment has been disclosed herein, variations thereof may occur to those skilled in the art. It is contemplated that all such variations and any modifications not departing from the spirit and scope of the invention hereof are to be construed in accordance with the following claims.

We claim:

1. A thermal transfer ribbon for use in nonimpact printing comprising a substrate and a thermal transfer layer which is formed from a mixture comprising the combination of a wax emulsion containing as essential ingredients about 20 to 45% oxidized, isocyanated hydrocarbon wax, about 35 to 65% paraffin wax mixture of solid crystalline hydrocarbons of the methane series derived from the paraffin distillate portion of crude petroleum, about 5 to 30% carnauba wax and about 3 to 15% ethylene vinyl acetate copolymer resin in a solvent solution and a fluorescent color coating containing as essential ingredients about 5 to 15% orange fluorescent pigment, about 1 to 10% white fluorescent pigment, and about 15 to 30% color toning pigment, the fluorescent pigments in the thermal transfer ribbon having a fluorescence greater than 10 postage meter units, the thermal transfer layer providing a transferred image of a color having a measure of lightness (L) in the range of 40 to 50, a measure (a) on the red-green axis and a measure (b) on the blue-yellow axis, and a total color difference value (Δ) of the transferred image not to exceed 10 when using the formula $(\Delta)=\sqrt{(\Delta L)^2+(\Delta a)^2+(\Delta b)^2}$ as measured on the Hunter Color Meter.

2. The ribbon of claim 1 wherein the first-mentioned fluorescent pigment is reddish-orange.

3. The ribbon of claim 1 wherein the color toning pigment is red.

4. A thermal transfer ribbon for use in nonimpact printing comprising a substrate and a thermal transfer coating which is formed from a mixture comprising the combination of a wax emulsion containing as essential ingredients about 20 to 45% oxidized, isocyanated hydrocarbon wax, about 35 to 65% paraffin wax mixture of solid crystalline hydrocarbons of the methane series derived from the paraffin distillate portion of crude petroleum, about 5 to 30% carnauba wax and about 3 to 15% ethylene vinyl acetate copolymer resin in a solvent solution and a fluorescent color coating containing as essential ingredients about 5 to 20% fluorescent pigment, about 1 to 10% of one toning pigment, and about 5 to 20% of another toning pigment, the fluorescent pigment in the thermal transfer ribbon having a fluorescence greater than 10 postage meter units, the thermal transfer coating providing a transferred image of a color having a measure of lightness (L) in the range of 40 to 50, a measure (a) on the red-green axis and a measure (b) on the blue-yellow axis, and a total color difference value (Δ) of the transferred image not to exceed 10 when using the formula $(\Delta)=\sqrt{(\Delta L)^2+(\Delta a)^2+(\Delta b)^2}$ as measured on the Hunter Color Meter.

5. The ribbon of claim 4 wherein the fluorescent pigment is reddish-orange.

6. The ribbon of claim 4 wherein the first-mentioned toning pigment is scarlet.

7. A thermal transfer ribbon for use in nonimpact printing comprising a substrate and a thermal transfer coating which is formed from a mixture comprising the combination of a wax emulsion containing as essential ingredients about 20 to 45% oxidized, isocyanated hydrocarbon wax, about 35 to 65% paraffin wax mixture of solid crystalline hydrocarbons of the methane series derived from the paraffin distillate portion of crude petroleum, about 5 to 20% carnauba wax, about 3 to 15% ethylene vinyl acetate copolymer resin, and about 1 to 25% hard, color stable styrene copolymer resin in a solvent solution and a fluorescent color coating containing as essential ingredients about 5 to 20% of one fluorescent pigment, about 3 to 10% of another fluorescent pigment, about 5 to 20% of one toning pigment, and about 1 to 10% of another toning pigment, the fluorescent pigments in the thermal transfer ribbon having a fluorescence greater than 10 postal meter units and a peak wavelength in the range of 600 to 650 nanometers, the thermal transfer coating providing a transferred image of a color having a measure of lightness (L) in the range of 40 to 50, a measure (a) on the red-green axis and a measure (b) on the blue-yellow axis, and a total color difference value (Δ) of the transferred image not to exceed 10 when using the formula $(\Delta)=\sqrt{(\Delta L)^2+(\Delta a)^2+(\Delta b)^2}$ as measured on the Hunter Color Meter.

8. The ribbon of claim 7 wherein said one fluorescent pigment is fire orange.

9. The ribbon of claim 7 wherein said one color toning pigment is red.

10. The ribbon of claim 7 wherein said another toning pigment is scarlet.

11. The ribbon of claim 7 wherein said another fluorescent pigment is red-orange.

12. A thermal transfer ribbon for use in nonimpact printing comprising a substrate and a thermal transfer coating which is formed from a mixture comprising the combination of a wax emulsion containing as essential ingredients about 20 to 45% oxidized, isocyanated hydrocarbon wax, about 35 to 65% paraffin wax mixture of solid crystalline hydrocarbons of the methane series derived from the paraffin distillate portion of crude petroleum, about 5 to 20% carnauba wax and about 3 to 15% ethylene vinyl acetate copolymer resin in a solvent solution and a fluorescent color coating containing as essential ingredients about 5 to 20% of red-orange fluorescent pigment, about 1 to 4% of a yellow fluorescent pigment, about 3 to 10% calcium carbonate filler, and about 5 to 10% of a red toning pigment, the fluorescent pigments in the thermal transfer ribbon having a fluorescence greater than 10 postal meter units and a peak wavelength in the range of 600 to 650 nanometers, the thermal transfer coating providing a transferred image of a color having a measure of lightness (L) in the range of 40 to 50, a measure (a) on the red-green axis and a measure (b) on the blue-yellow axis, and a total color difference value (Δ) of the transferred image not to exceed 10 when using the formula $(\Delta)=\sqrt{(\Delta L)^2+(\Delta a)^2+(\Delta b)^2}$ as measured on the Hunter Color Meter.

13. The thermal transfer ribbon of claim 11 wherein said fluorescent color coating occupies approximately one-half of the surface of the substrate and a thermal transfer coating of another color occupies approximately the remaining one-half of the surface of the substrate along the length thereof.

14. The thermal transfer ribbon of claim 12 wherein said fluorescent color coating occupies a portion of the surface of said substrate and a thermal transfer coating of another color occupies the surface of an adjacent portion in repeated manner along the length of the substrate.

15. The thermal transfer ribbon of claim 12 wherein said thermal transfer coating equates to a coating weight of between 9 and 16 milligrams per four square inches on said substrate.

* * * * *